US008873767B2

(12) United States Patent
Regler

(10) Patent No.: US 8,873,767 B2
(45) Date of Patent: Oct. 28, 2014

(54) AUDIO OR AUDIO/VISUAL INTERACTIVE ENTERTAINMENT SYSTEM AND SWITCHING DEVICE THEREFOR

(75) Inventor: Jason Regler, Trowbridge (GB)

(73) Assignee: RB Concepts Limited (GB)

( * ) Notice: Subject to any disclaimer, the term of this patent is extended or adjusted under 35 U.S.C. 154(b) by 816 days.

(21) Appl. No.: 12/936,261

(22) PCT Filed: Mar. 27, 2009

(86) PCT No.: PCT/GB2009/000796

§ 371 (c)(1),
(2), (4) Date: Oct. 4, 2010

(87) PCT Pub. No.: WO2009/122142

PCT Pub. Date: Oct. 8, 2009

(65) Prior Publication Data

US 2011/0025912 A1 Feb. 3, 2011

(30) Foreign Application Priority Data

Apr. 2, 2008 (GB) ..... 0805925.5
Jun. 5, 2008 (GB) ..... 0810296.4

(51) Int. Cl.
*H04R 27/00* (2006.01)
*H04R 1/02* (2006.01)
*A61H 19/00* (2006.01)

(52) U.S. Cl.
CPC ..... *H04R 1/028* (2013.01); *A61H 2201/5048* (2013.01); *A61H 2201/5015* (2013.01); *A61H 19/00* (2013.01); *A61H 2201/5097* (2013.01); *H04R 2420/07* (2013.01)
USPC ..... 381/85; 381/105; 381/315

(58) Field of Classification Search
USPC ..... 381/123, 315, 105, 85
See application file for complete search history.

(56) References Cited

U.S. PATENT DOCUMENTS

| | | | |
|---|---|---|---|
| 4,846,693 | A | 7/1989 | Baer |
| 5,636,994 | A | 6/1997 | Tong |
| 5,977,951 | A | 11/1999 | Danieli et al. |
| 6,012,961 | A | 1/2000 | Sharpe et al. |

(Continued)

FOREIGN PATENT DOCUMENTS

| | | | |
|---|---|---|---|
| CA | 2229759 | A1 | 8/1998 |
| EP | 0195627 | A2 | 9/1986 |

(Continued)

*Primary Examiner* — Davetta W Goins
*Assistant Examiner* — Amir Etesam
(74) *Attorney, Agent, or Firm* — Aka Chan LLP

(57) ABSTRACT

The present invention concerns an audio switching device for an audio or audio/video entertainment system having multiple audio channels; the device comprising at least two audio inputs for receiving at least two respective input signals from a media source on respective input channels, and switching means for selectively switching the device, independently of an actuating signal embedded in the input signals, between a first mode of operation in which respective audio input signals are output to respective audio reproduction means for stereo/multi-channel reproduction of the audio content of the said audio signals, and a second mode in which at least one of the said audio channels is switched to a respective audio output connected to a wireless transmitter for transmission of a media source input signal, including control and or audio information, to at least one remote device for controlling movement/animation of the said remote device and/or reproducing audio content of the signal at the said remote device.

19 Claims, 19 Drawing Sheets

(56) References Cited

U.S. PATENT DOCUMENTS

| | | | | |
|---|---|---|---|---|
| 6,317,714 | B1 | 11/2001 | Del Castillo et al. | |
| 7,043,034 | B2 * | 5/2006 | Poling et al. | 381/123 |
| 7,190,798 | B2 * | 3/2007 | Yasuhara | 381/86 |
| 7,684,570 | B2 * | 3/2010 | Riggs | 381/86 |
| 7,937,118 | B2 * | 5/2011 | Coutinho et al. | 455/569.1 |
| 7,983,176 | B2 * | 7/2011 | Chen et al. | 370/247 |
| 2003/0002682 | A1 * | 1/2003 | Smith et al. | 381/2 |
| 2003/0064818 | A1 * | 4/2003 | Drosendahl et al. | 472/118 |
| 2005/0055545 | A1 * | 3/2005 | Guo et al. | 713/1 |
| 2006/0083388 | A1 * | 4/2006 | Rothschild | 381/81 |
| 2006/0146043 | A1 * | 7/2006 | Tseng et al. | 345/211 |
| 2006/0165244 | A1 | 7/2006 | Wu | |
| 2006/0222186 | A1 * | 10/2006 | Paige et al. | 381/81 |
| 2006/0259642 | A1 * | 11/2006 | Du et al. | 709/247 |
| 2007/0055096 | A1 | 3/2007 | Berry et al. | |
| 2007/0055399 | A1 | 3/2007 | Litbak et al. | |
| 2007/0137988 | A1 * | 6/2007 | Yu et al. | 200/4 |

FOREIGN PATENT DOCUMENTS

| | | | |
|---|---|---|---|
| EP | 1511352 | A1 | 3/2005 |
| FR | 2834913 | A1 | 7/2003 |
| GB | 2442644 | A | 4/2008 |
| WO | 2005006743 | A1 | 7/2005 |
| WO | 2007029247 | A2 | 3/2007 |
| WO | 2008155753 | A2 | 12/2008 |

* cited by examiner

1. Audio out R
2. Audio in R
3. Audio out L
4. Audio ground
5. RGB blue ground
6. Audio in L
7. RGB blue
8. SWITCH
9. RGB green ground
10. Clock out
11. RGB green
12. Data line out
13. RGB red ground
14. Data ground
15. RGB red / chrom. SVHS
16. RGB switch
17. Video out ground
18. Video in ground
19. Video out
20. Video in / lumin. SVHS
21. Ground Note: This process can also be done the other way around if the wireless speaker transmitter is plugged into the television/DVD's right audio port and the speaker into the left

Game Controller

AUDIO OR AUDIO/VISUAL INTERACTIVE ENTERTAINMENT SYSTEM AND SWITCHING DEVICE THEREFOR

This invention relates to an audio or audio/visual (AV) interactive entertainment system and switching device and particularly concerns the system and device for use with AV equipment having two or more audio channels.

Interactive audio-visual entertainment systems have been proposed where a remote device such as a doll or plush toy interacts with audio and/or visual content reproduced on a listening or viewing platform. For example U.S. Pat. No. 5,636,994 describes a computer system where one of the two stereo audio channels from a sound processor is hard wired for transmission to a plush toy, so that the stereo soundtrack is reproduced on one channel through a speaker provided in the plush toy, and the other through a speaker connected on the other channel to the computer system. The audio signals for the sounds to be reproduced by the plush toy are directed to the left audio output channel of the sound processor and the signal for all other sounds are directed to the right output channel. The audio content associated with the plush toy is therefore reproduced by the speaker in the toy and all other sounds, for example voices of other characters that appear on the screen of the computer system, are reproduced by the speaker associated with the system and appear to come from the characters displayed on the screen. In the arrangement described the system is hard wired and does not provide for selective switching of the audio output between the plush toy and another speaker so as to provide stereo sound output from the computer system other than through the speaker mounted in the plush toy.

WO2007/029247 describes an audio switching system where the audio signal on one of the channels are redirected to a transmitter for transmission to a remote device doll on detection of an embedded actuation signal added to the audio channel for signalling the switching between modes. When switching occurs the audio signal on the other channel is split to provide split mono-audio to both audio outputs. The arrangement described in this document requires there to be a level of signal processing, with a signal processor associated with at least one of the audio inputs. This provides a more complicated system than that disclosed in U.S. Pat. No. 5,636,994 discussed above but does provide for normal stereo operation in the un-switched mode.

There is a requirement for a simple system, and in particular a switching device which can be implemented in or with existing AV equipment such as dvd players, satellite receivers, CATV receivers and the like including any media platform that is provided with multiple audio channels for stereo or surround sound output.

According to an aspect of the present invention there is provided an audio switching device for an audio or audio/video entertainment system having multiple audio channels; the device comprising at least two audio inputs for receiving at least two respective input signals from a media source on respective input channels, and switching means for selectively switching the device between a first mode of operation in which respective audio input signals are output to respective audio reproduction means for stereo/multi-channel reproduction of the audio content of the said audio signals, and a second mode in which at least one of the said audio channels is switched to a respective audio output connected to a wireless transmitter for transmission of a media source input signal, including control and/or audio information, to at least one remote device for controlling movement/animation of the said remote device and/or reproducing audio content of the signal at the said remote device.

The audio switching device of the present invention readily enables existing AV equipment to be utilised in an AV interactive entertainment system since it readily enables an existing audio channel to be selectively switched so that signals on a particular channel are sent for transmission to one or more remote devices, independently of a predefined actuation signal being embedded in the input signal on the channel to be switched. The present invention provides a much simpler system than has presently been proposed since the device has two modes of operation and does not switch between these modes once one has been selected, that is to say the switching device configures the AV equipment for normal use or for use in the interactive mode with one or more remote devices. Once the interactive mode has been selected dynamic switching between the two different modes does not occur, as it does in the case of the system disclosed in WO2007/029247 due to the presence of a signal processor and embedded actuation signals in the audio signal. Further advantages of the switching device of the present invention will become apparent from the description that follows.

Preferably, the said switching means is arranged to additionally connect, in the said second mode, the audio input signal of another of the said input channels to the respective audio reproduction means connected to the switched channel in the said first mode. In this way in a stereo system the audio signal on the channel that is not diverted for transmission to the remote device is split to provide split mono-audio to both stereo audio outputs.

In preferred embodiments the said switching means is selectively switched between the said first and second modes when power to the said switching device is switched between a first state and a second state. Preferably, the said device operates in the said first mode when it is switched off and in the said second mode when the device is switched on. This provides a simple and robust switching device which is either "on" or "off" and when the device is turned off, in the sense that it does not draw any power, the switch operates in a passive mode and the respective audio channels and signals carried by the channels pass straight through the switching device such that, for example, in a stereo arrangement the left and right audio inputs are directly connected to the left and right outputs, respectively, of the device. When the switching device is switched on so that if draws power the switch is configured for the second mode of operation and maintains this state for the duration of the time that it is on. In this respect the switching device of the present invention provides a device that is relatively simple and straightforward to use. Preferably the audio switching device comprises a physical switch for switching the device between the first and second modes, that is to say a simple on/off switch can be provided on the device so that the action of switching it on configures it for interactive operation.

In preferred embodiments the media source input signal may include control information, for example DTMF, SELCALL or sub-audio control signals. These control signals may be provided additionally or alternatively to audio signals on the same audio channel. In this way control signals may be transmitted to the remote device or devices for synchronised interactive control. Control signals may be provided in addition to audio signals to the remote device or devices. This can be particularly advantageous when it is desired to provide animation control signals in addition to audio for creating animation along with reproduction of the content of the audio signal at the remote device. In preferred embodiments the device includes two stereo audio inputs, L and R, for connection in said first mode to respective first and second speakers to provide stereo sound reproduction of said media source audio signals, and wherein the said device is arranged to switch one of the said audio input channels to the said transmitter in said second mode and connect the other input channel to both said first and second speakers to provide mono sound reproduction in said second mode. In this way the switching device of the present invention can be utilised in an AV entertainment system comprising existing AV equipment having stereo audio functionality.

According to another aspect of the present invention there is provided an audio or audio/video interactive entertainment system for processing multiple audio channel data for providing real time synchronous interaction with remote device (s): the system comprising an audio and/or video media source, a transmitter for transmitting data from said media source to at least one remote device having a receiver, an audio switching device having at least two audio inputs for receiving at least two respective input signals from said media source on respective input channels, and switching means for selectively switching the device, independently of an actuating signal embedded in the input signals, between a first mode of operation in which respective audio input signals are output to respective audio reproduction means for stereo/multichannel reproduction of the audio content of the said audio signals, and a second mode in which at least one of the said audio channels is switched to a respective audio output connected to said transmitter for transmission of a media source input signal, including control and/or audio information, to at least one remote device for controlling movement and/or animation of the said remote device and/or reproducing audio content of the signal at the said remote device.

Various embodiments of the present invention will now be more particularly described, by way of example only, with reference to the accompanying drawings of FIG. 1 to 33.

FIG. 1 shows the pin arrangement of a Euro SCART AV connector lead which can be adapted for use in the present invention by adapting the SCART connector to isolate either the right or left audio channel to provide a modified lead 10 as shown in FIGS. 2 and 3. In FIG. 2 it can be seen that a phono lead 12 isolates a desired audio channel (L or R). The phono lead 12 is terminated with a four-pole phono connector or jack 14 which connects to a split audio control unit (not shown in the current view) which includes a DTMF decoder or wireless speaker transmitter or both as will be described in detail below. The modified SCART lead with separate phono connector is shown in FIG. 3.

As can be seen in the schematic representation of FIG. 4 the phono lead 12 may be connected to an inline SCART adaptor 16 instead of to the SCART lead 10. In this arrangement the SCART lead fits in to the back of the adaptor and the phono lead on the adaptor isolates the desired audio channel in the same way. The adaptor can be plugged into a television or dvd player as can be seen in the drawings of FIGS. 5 and 6 with the SCART lead end attached to the adaptor. In FIGS. 5 and 6 the connection of the phono lead 12 to the split audio control unit 18 is shown schematically at 20.

A similar arrangement is shown in FIG. 7 where an audio channel isolation adaptor 22 is provided for use with AV equipment having AV leads including video 24, left speaker 26, and right speaker 28 leads. The adaptor 22 separates the audio channels so that the audio from one of the leads goes to the phono lead 12 connected to the adaptor 22 and the audio from the other channel goes to both audio out AV cables 30, 32 to provide a split mono arrangement. The AV leads from the television, dvd player or other media source platform are plugged into the adaptor 22 as indicated. The phono lead 12 isolates one of the audio channels, for example the left channel, and is similarly connected to a split audio control unit (not shown in this view), as in the previous arrangement. The adaptor 22 sends the audio signal from the other channel to both left and right speakers via the AV cables 30 and 32. The adaptor 22 can be plugged into the back of a television or dvd player or other AV device, for example as shown in FIG. 8 where the adaptor 22 is indicated as being plugged into the back of the television 34.

Figure 1:
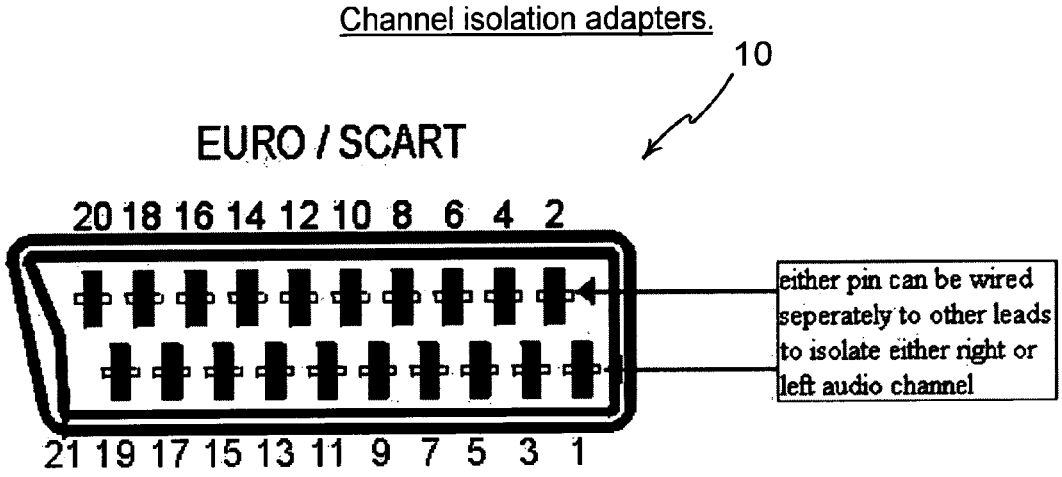
FIG. 1 shows the pin arrangement of a Euro SCART AV connector lead which can be adapted for use in the present invention.
Figure 2:
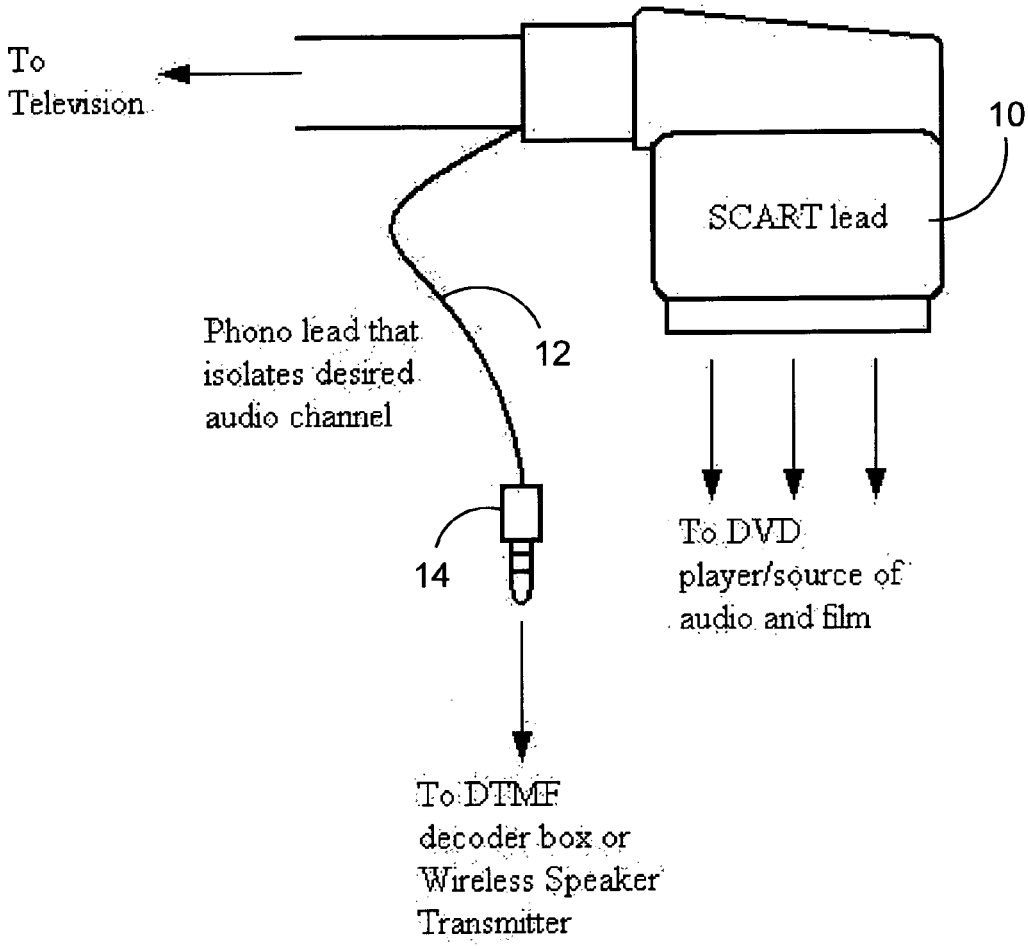
FIG. 2 shows an adaption of the SCART connector with a phono lead with the isolated audio channel in accordance with one embodiment of the present invention.
Figure 3:
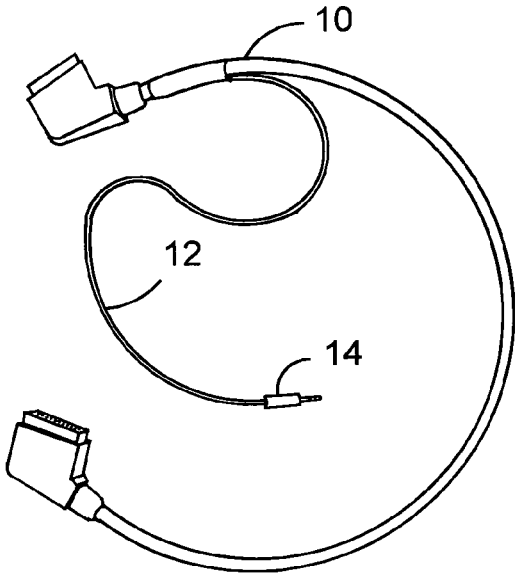
FIG. 3 shows the modified SCART lead of FIG. 2 with the separate phono connector.
Figure 4:
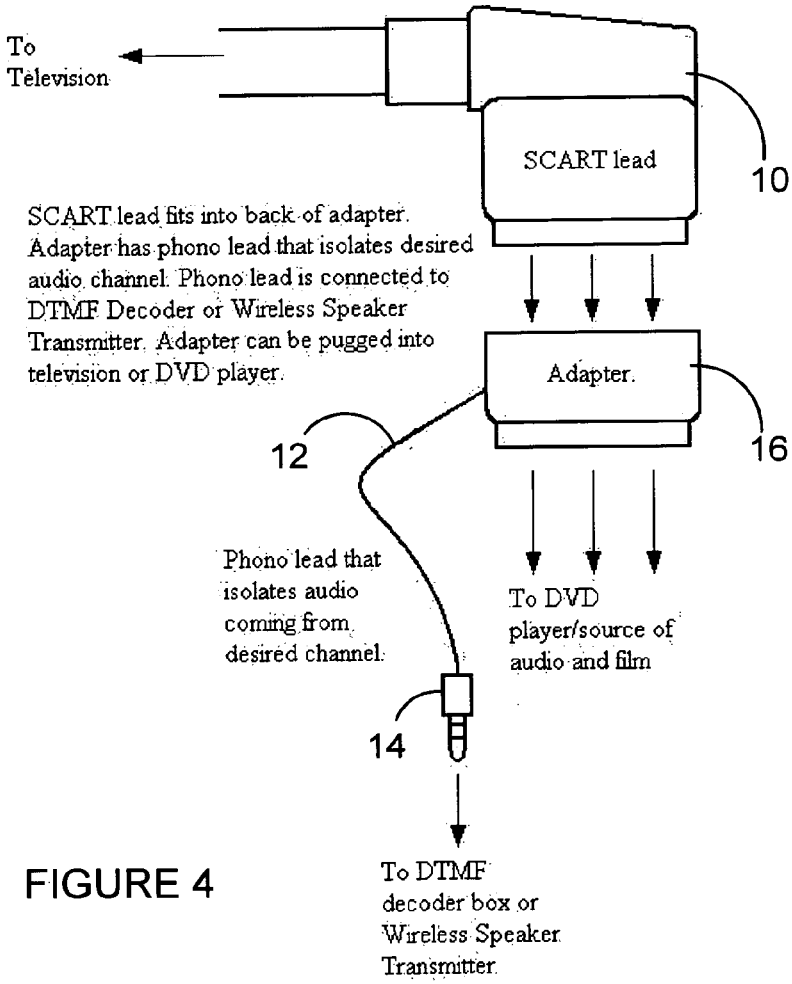
FIG. 4 shows an arrangement in which the phono lead is connected to an inline SCART adaptor instead of the SCART lead, which can adapted for use in the present invention.
Figure 5:
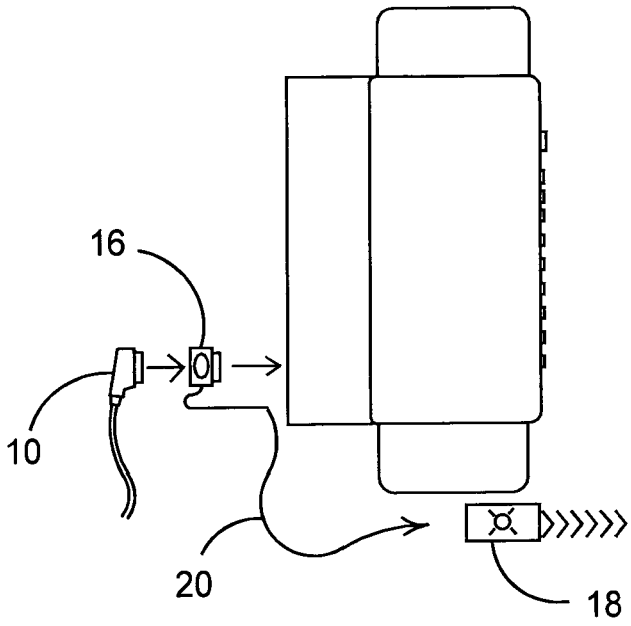
FIG. 5 illustrates the arrangement of FIG. 4 with the connection of the SCART lead and adaptor to a television, and the phono lead to an audio control unit.
Figure 6:
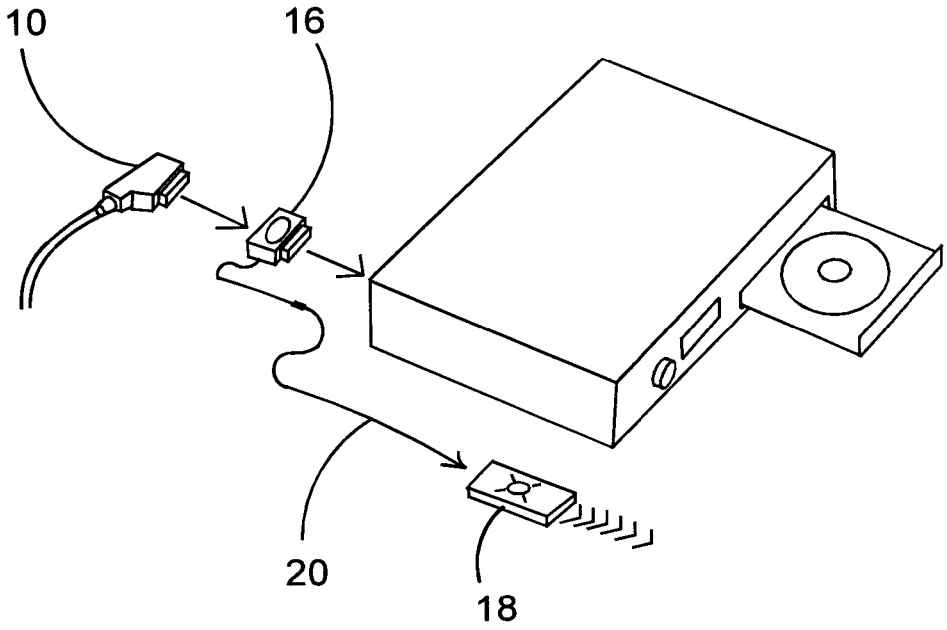
FIG. 6 illustrates the arrangement of FIG. 4 with the connection of SCART lead and adaptor to a DVD player, and the phono lead to an audio control unit.
Figure 7:
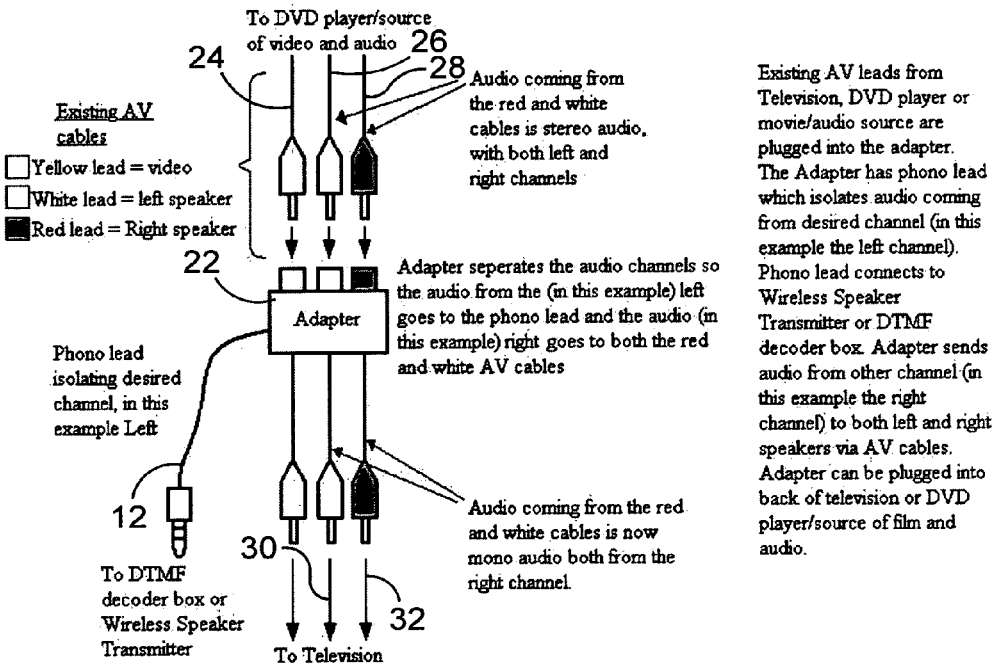
FIG. 7 shows an arrangement in which AV leads are connected to an audio channel isolation adaptor which isolates one of the audio channels to a phono lead in accordance with an embodiment of the present invention.
Figure 8:
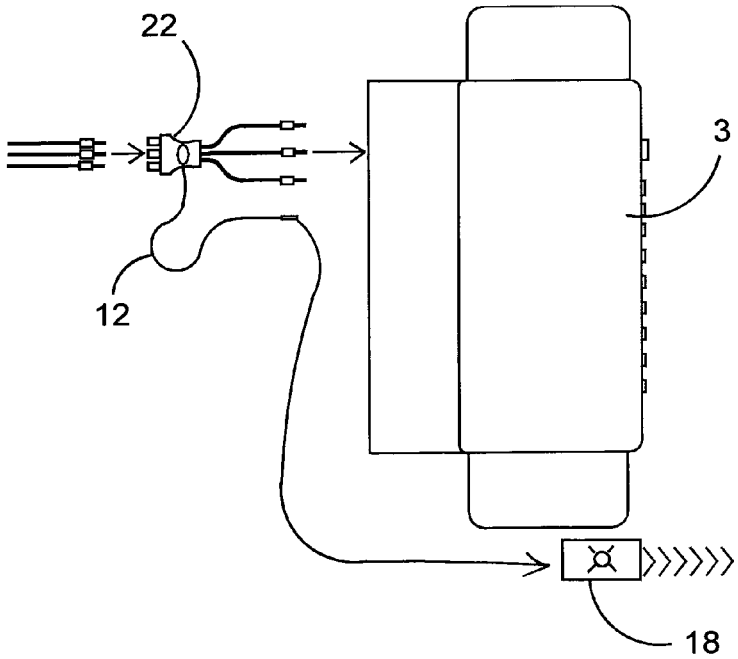
FIG. 8 illustrates the arrangement of FIG. 7 in which the connection of the audio channel isolation adaptor to a television, and the phono lead to an audio control unit.
Figure 9:
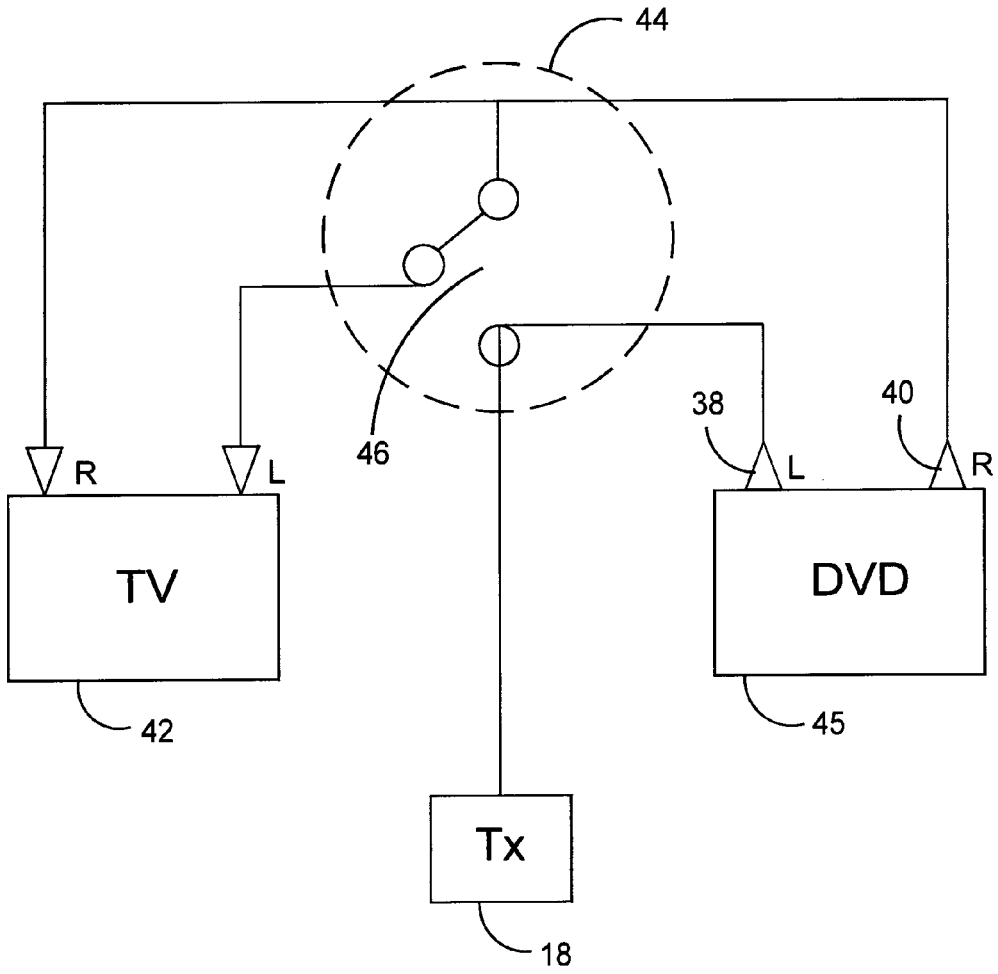
FIG. 9 shows a diagram of a switching circuit of an audio switching device, part of the audio control unit.
Figure 10:
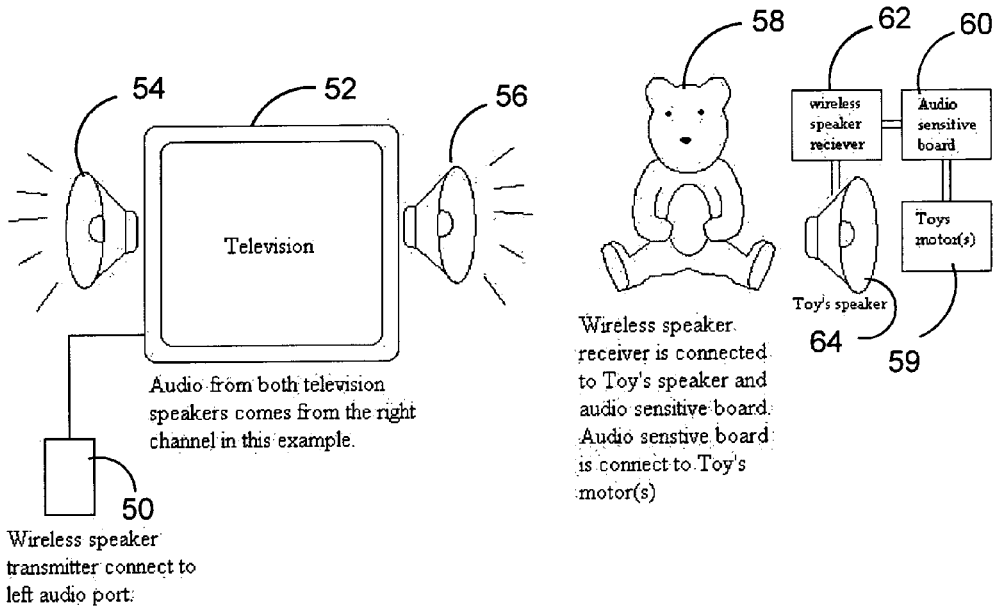
FIG. 10 shows an exemplary arrangement by which a first (the right) audio channel is connected to the speakers of a television and a child's plush toy receives the other (left), isolated, audio channel by a wireless connection in accordance with an embodiment of the present invention.

The split audio control unit 18 comprises an audio switching device and a wireless transmitter, preferably a radio frequency wireless transmitter. The audio switching device can best be explained with reference to the circuit diagram of FIG. 9 where a dvd player includes left and right audio outputs 38 and 40 with the right audio output connected directly to the right audio input of a television 42. The left audio output is connected to the left audio input of the television via the switching arrangement indicated at 44, where the switch 46 connects the left audio output 38 to the left audio input on the TV in a first state and connects the right audio output 40 of the dvd player to the left audio input of the TV in a second state, as illustrated in FIG. 9, to isolate the left audio output to the split audio control unit 18. In preferred embodiments the switch 46 comprises a mechanical switch or relay which also functions as the power on/off switch of the split audio control unit 18.

In embodiments of the present invention the split audio control unit 18 not only includes the switching circuit 44 but also includes a DTMF decoder and additionally or alternatively a wireless speaker transmitter in addition to a radio frequency transmitter for transmitting signals carried on the isolated audio channel to one or more remote devices, examples of which are described below. The split audio control unit may be used with various types of AV devices including dvd players and recorders, radio receivers, personal computers including laptops, television, i-pods, mobile phones, games consoles, portable entertainment devices such as mp3/mp4 players etc, vhs video recorders, cd players, in fact any media platform that uses stereo, audio or other multi-channel audio such as surround sound.

In the following examples the viewing platform is provided by a television but it is to be understood that this could be replaced with any of the aforementioned viewing or listening devices. It is also to be understood that in the following examples the DTMF decoder and/or wireless speaker transmitter do not have to be connected to the viewing platform or input device via a channel isolation adaptor, such as a phono lead as previously described, as any type of lead adaptor or arrangement would be sufficient provided that the DTMF decoder box or wireless speaker transmitter receives signals from only one audio channel.

EXAMPLE 1

(FIGS. 10 to 14) Wireless Speaking Toy

Toy Setup

In this example a wireless speaker transmitter 50 is connected into the left audio channel (in this example) of the Television/viewing platform, so that the transmitter only transmits the audio intended to reach the left speaker.

The speakers 54, 56 are connected to the right audio channel of the Television/DVD, so that the speakers only produce audio intended for the right channel i.e. split mono audio.

In this example the remote device is a child's plush toy 58. The toy's motors are connected to an audio sensitive board 60 so that the mechanical pieces of the toy desired to move (e.g. mouthparts), move in time with the audio received.

A wireless speaker receiver 62 is connected to the audio sensitive board, and a speaker 64 inside the toy.

An audio signal is transmitted from the Wireless speaker transmitter connected to the televisions left audio channel. This signal is received by the Wireless speaker receiver inside the toy. The speaker inside the toy then produces the audio received from the left channel. At the same time the audio sensitive board connected to the wireless speaker receiver moves the toys motor(s) and associated mechanical parts in time with the audio. This gives the impression that the toy is interacting/communicating with the television or viewing platform.

Figure 11:
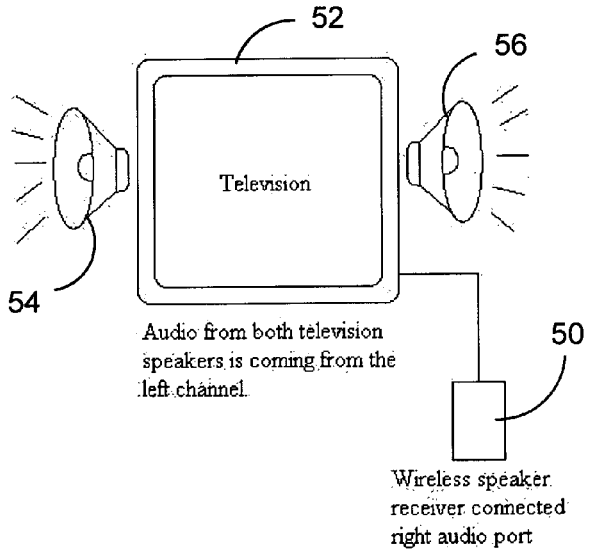
FIG. 11 shows the same connections as that of FIG. 10, except that the other (left) audio channel is connected to the television speakers and the child's plush toy receives the other (right), isolated, audio channel by a wireless.

As shown in FIG. 11 this setup can also be reversed and give the same effect provided that the audio channels on the source of input (e.g. DVD) are also reversed.

Media Setup

Figure 12:
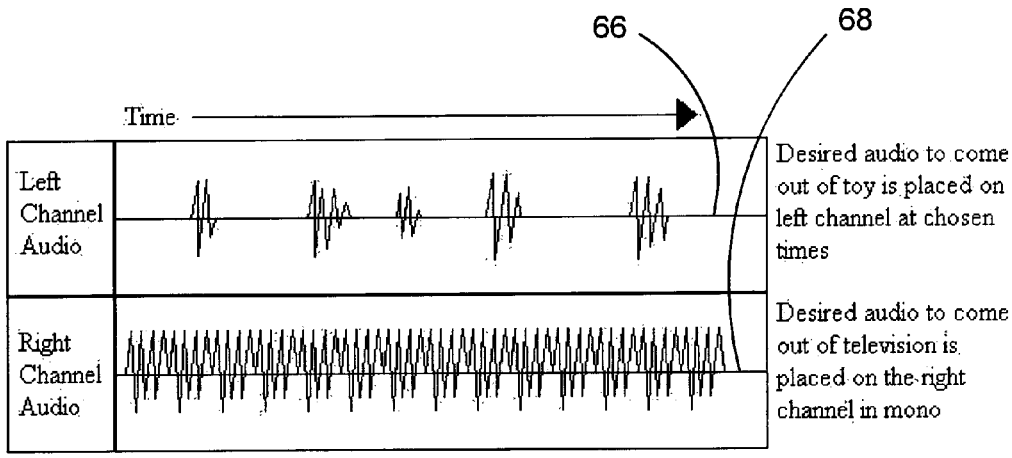
FIG. 12 shows a representation of the audio signals carried by the right and left audio channels for the FIG. 10 arrangement.
Figure 13:
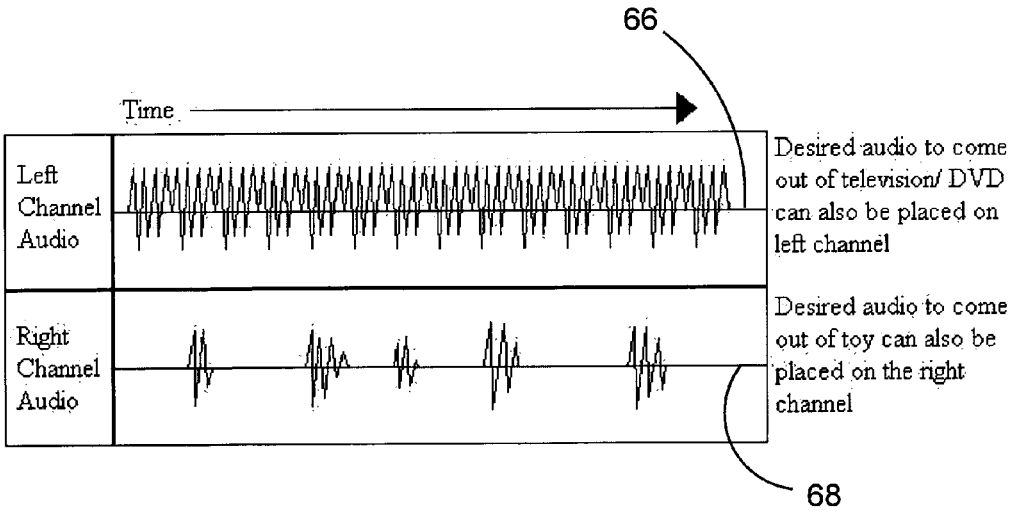
FIG. 13 shows a representation of the audio signals carried by the right and left audio channels for the FIG. 11 arrangement.

Referring now to FIG. 12:

The audio chosen to be spoken by the toy and not reproduced at the television is isolated and placed on one audio channel only, in this example the left 66.

The audio/soundtrack/dialogue intended for the television, not the toy, is placed entirely on the other audio channel in mono, in this example the right channel 68.

The audio desired to be reproduced by the toy is placed at selected times in correlation with the movie/audio on the left channel. This gives the effect that the toy is interacting/communicating in real time with the television.

In arrangements where more than one toy is used the audio from the toy is 'normalised' using video editing software to ensure that the audio from of all the toys is at the same volume.

Figure 14:
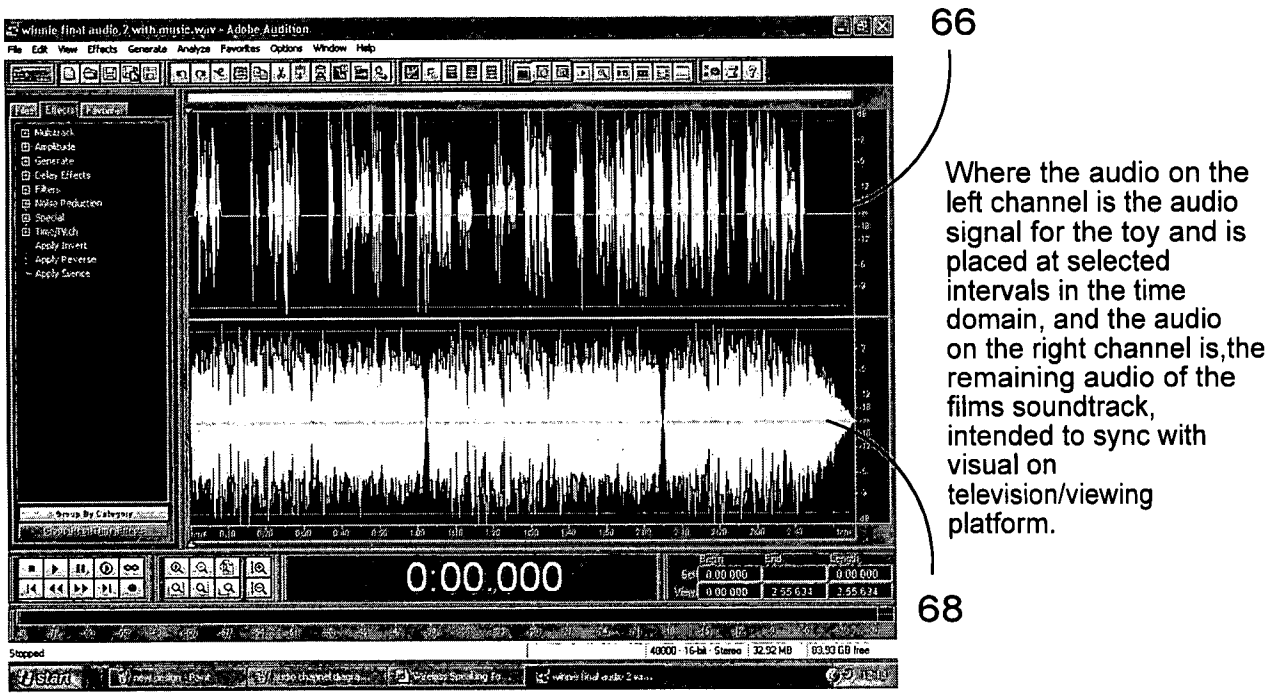
FIG. 14 shows a picture of the right and left audio signals in a typical audio sequence for a FIG. 10 arrangement.
Figure 15:
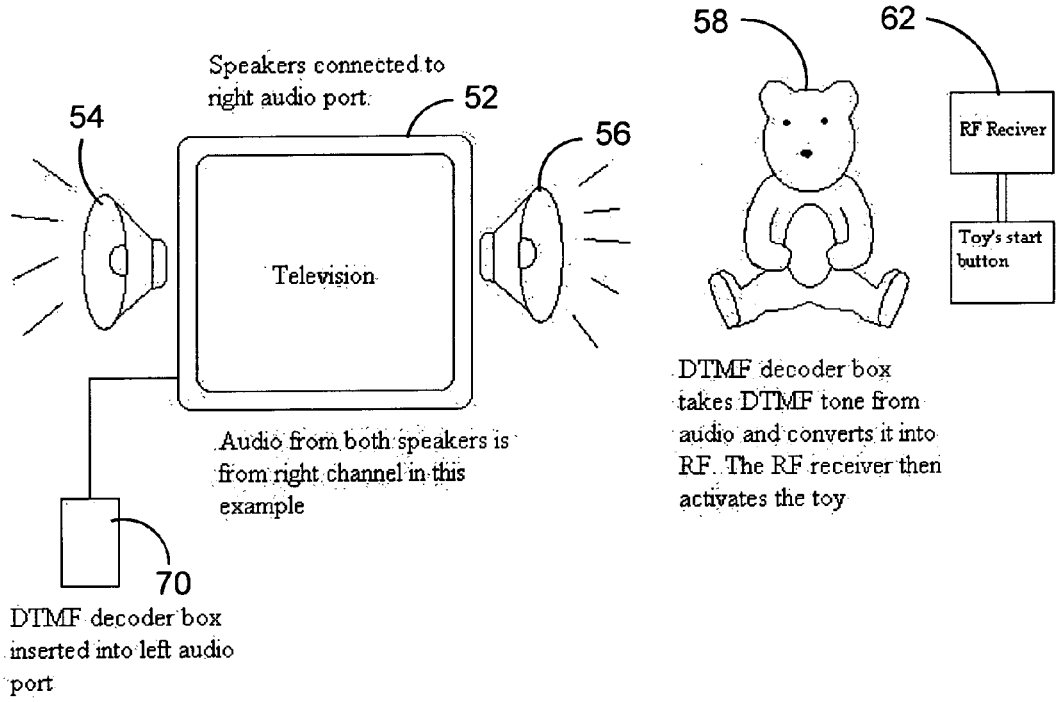
FIG. 15 shows an exemplary arrangement similar to that of FIG. 10, except that a DTMF decoder is connected to the left audio channel which is transmitted to the toy in accordance with an embodiment of the present invention.

The left and right audio signals of a typical audio sequence are shown in FIG. 14, It is to be understood that in the present invention this type of toy can also be activated with wires, by connecting an audio lead directly from the toy's audio sensitive board to the isolated audio channel of the selected platform (television, CD player, personal entertainment device) containing the toys desired audio.

EXAMPLE 2

(FIGS. 15 to 19) Tone Controlled Toys

Toy Setup

In this example a DTMF decoder 70 is connected to a selected audio channel via channel isolation adapters, in this example the DTMF decoder is connected to the left channel 66.

Speakers 54, 56 are connected to the television/viewing platform 52; the television audio in this example is coming from the right channel.

The toy contains an RF receiver 62 that turns on a selected function of the toy when it receives RF from the DTMF decoder box 70.

Figure 16:
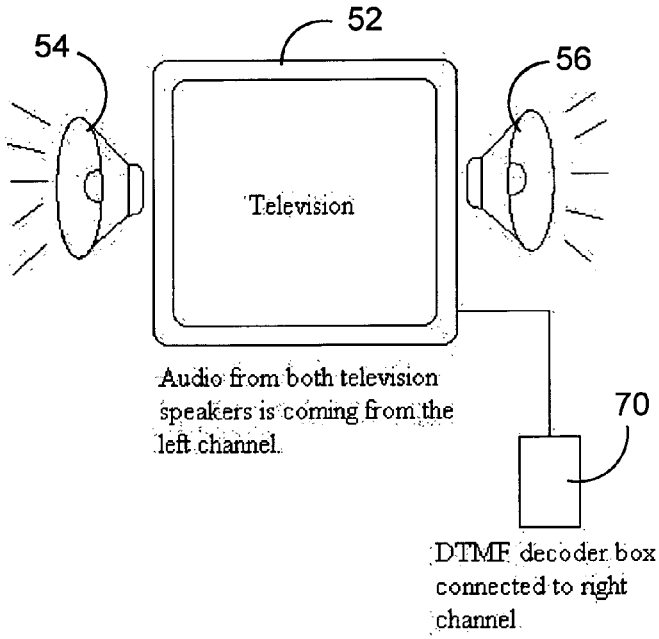
FIG. 16 shows an arrangement similar to that of FIG. 15, except that the arrangement of the audio channels is reversed.

This setup can also be wired the other way round and perform the same function depending on which channel the DTMF tones have been placed on the audio, for example as shown in FIG. 16.

Media Setup

Figure 17:
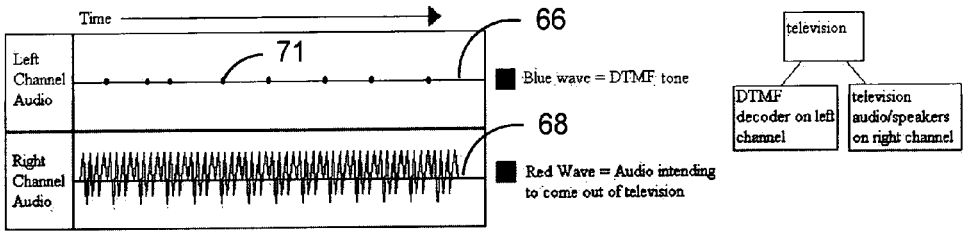
FIG. 17 shows a representation of the audio signals carried by the right and left audio channels for the FIG. 15 arrangement with DTMF signals in the left audio channel.
Figure 18:
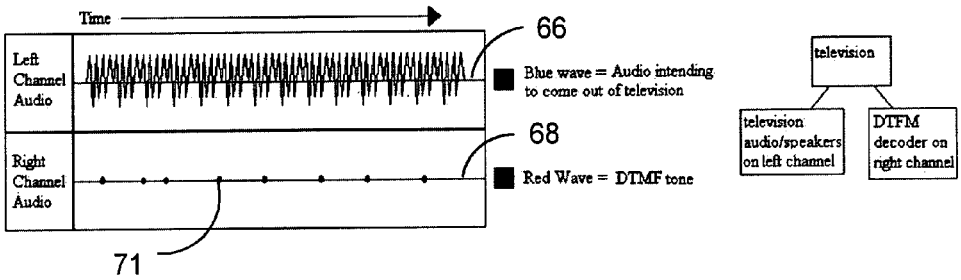
FIG. 18 shows a representation of the audio signals carried by the right and left audio channels for the FIG. 16 arrangement with DTMF signals in the right audio channel.
Figure 19:
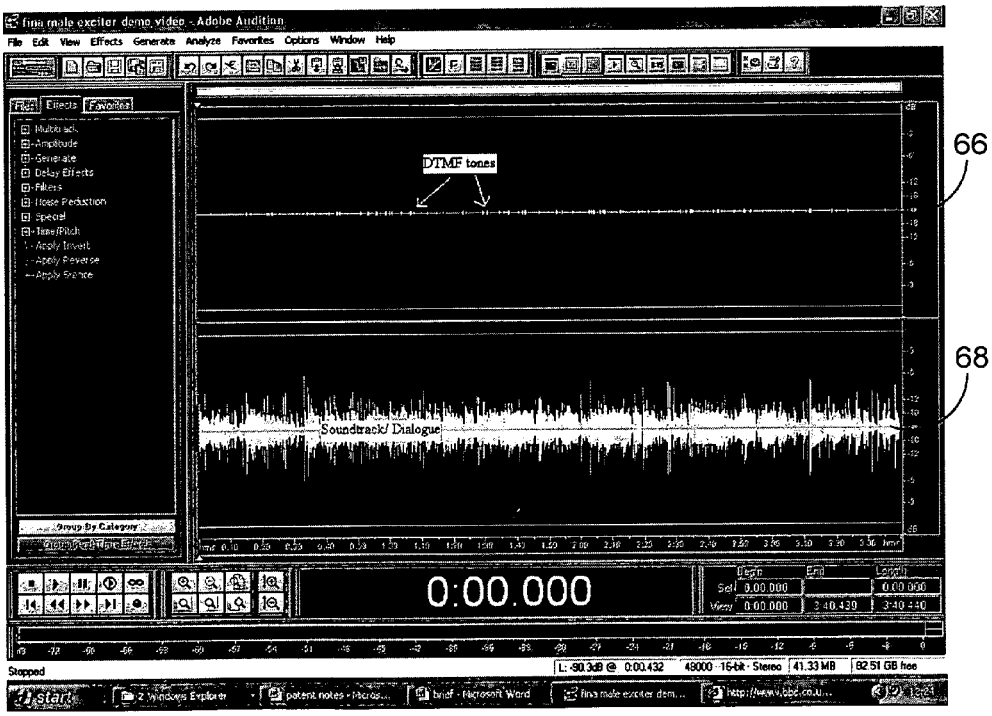
FIG. 19 shows a picture of the right and left audio signals in a typical audio sequence for a FIG. 15 arrangement.

The audio designated to come from the television that is the part of the soundtrack/dialogue that is not to be reproduced by the toy is placed in mono on one channel, in the example of FIG. 17 this is the right channel 68.

The DTMF tone used to activate the toy is placed entirely on the other audio channel, the left channel in FIG. 17.

The DTMF tone is set at a particular volume using video editing software.

The DTMF tone is placed at a specific point 71 in the time domain to correlate with what is happening on the television screen, giving the impression that the toy is interacting/communication with what is being viewed on the television.

Each DTMF tone is associated with a particular animated movement of the toy or activates a pre-recorded audio message stored in the toy.

EXAMPLE 3

Figure 20:
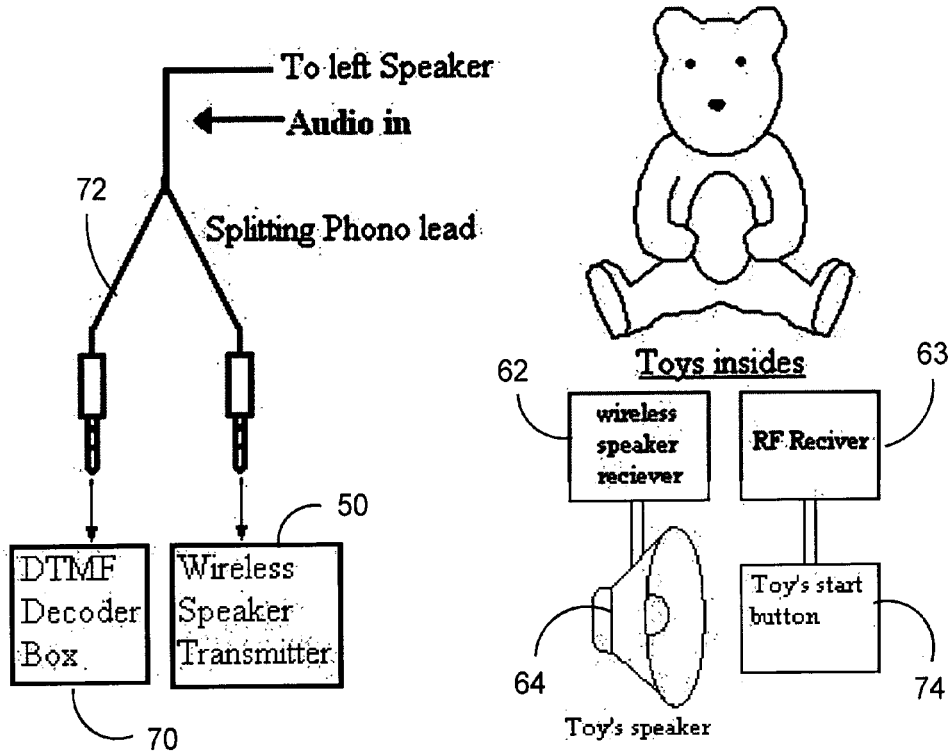
FIG. 20 shows an exemplary arrangement in which the isolated audio channel lead is split and connected to a DTMF decoder and a wireless speaker transmitter for the transmission of DTMF tones and audio speaker signals are sent to a toy, according to an embodiment of the present invention.

(FIGS. 20 to 22) Combining Both DTMF Decoder Box and Wireless Speaker Toy Setup In this example, the embodiments of Examples 1 and 2 are combined.

A phono splitter lead 72 is connected to the phono lead on the channel isolation adapter. In this example the left channel.

Both the DTMF decoder box 70 and Wireless Speaker Transmitter 50 are connected to the splitting phono lead, so that both the DTMF decoder box and Wireless Speaker Transmitter receive audio from the left channel.

The toy has both a Wireless speaker receiver and an RF receiver.

The Wireless speaker receiver is connected to the speaker inside the toy.

The RF receiver is connected to the toys start buttons 74.

Figure 21:
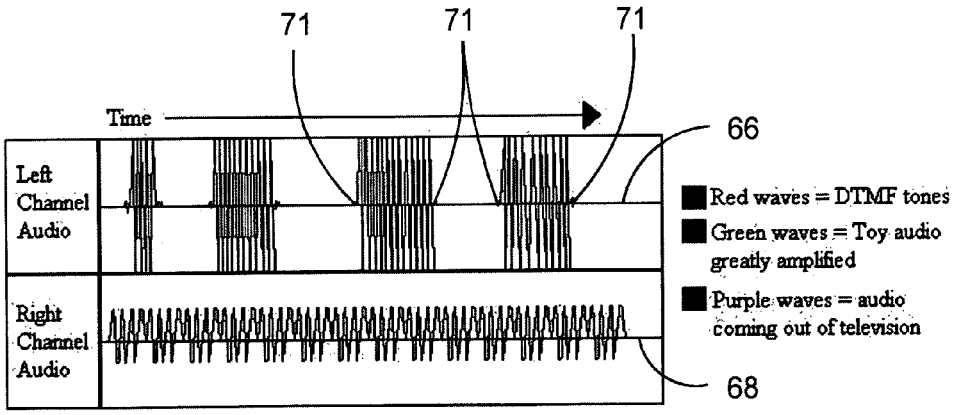
FIG. 21 shows a representation of a combination of DTMF and audio speaker signals in the isolated (left) audio channel and the audio signals in the other (right) channel for the FIG. 20 arrangement.

When the video media is playing, the toy will perform a desired function at selected times using the DTMF tones 71, in this example on the left channel, which act as function call signals, as shown in FIG. 21.

The toy will also play selected audio that is placed, in this example, on the left channel, as also shown in FIG. 21.

This setup can also be reversed and give the same effect provided that the audio channels on the source of input (e.g. DVD/iPod) are also reversed.

In order to not hear the DTMF tones along with the toy audio, the toy's audio is greatly amplified. When the desired audio is reproduced by the toy, the volume of the toy's speaker is turned down to a level where the toy's greatly amplified audio sounds 'comfortable' to the listener, thus turning down the DTMF tones to a volume where they cannot be heard. At the same time the DTMF decoder receives tones and activates the toys desired functions.

Figure 22:
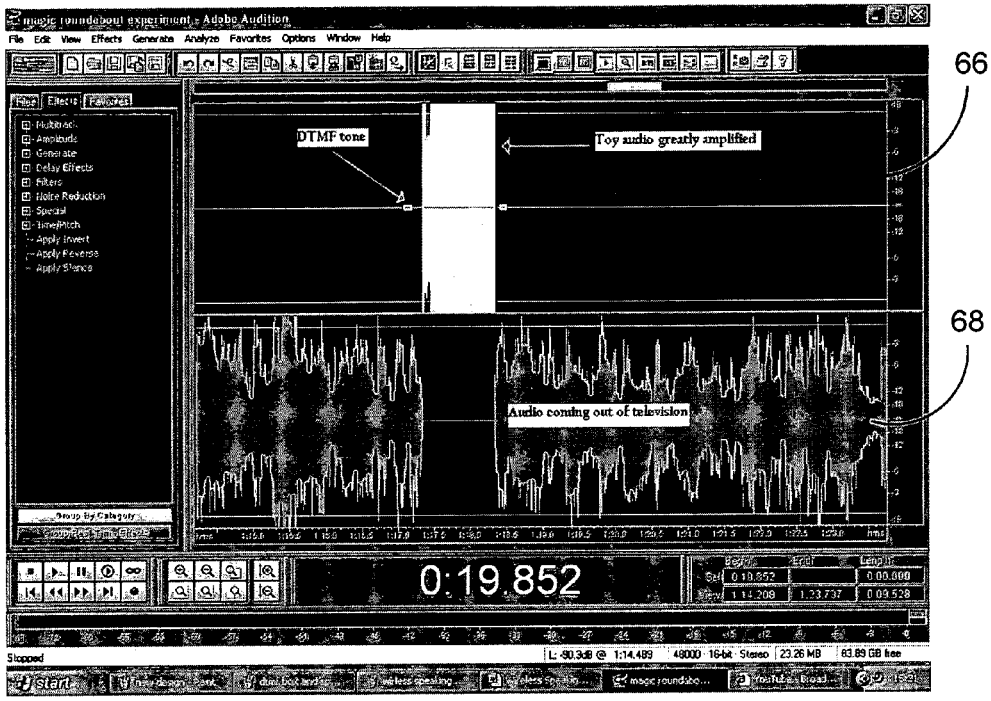
FIG. 22 shows a picture of the combined DTMF/audio speaker audio signals over time for the FIG. 20 arrangement.
Figure 23:
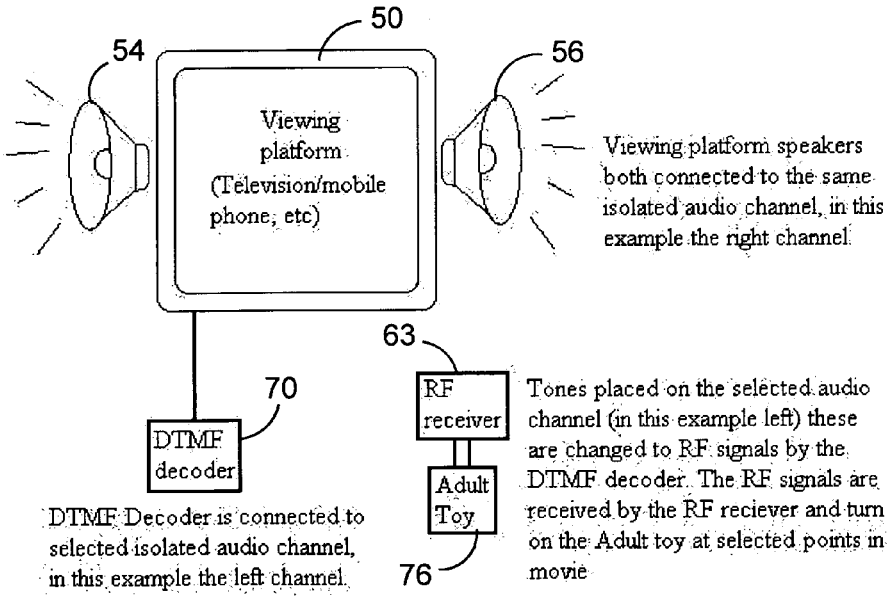
FIG. 23 shows an exemplary arrangement by which an adult toy wirelessly receives DTMF signals over a selected audio channel, and the speaker(s) of a viewing platform, such as a television, receives audio signals over the other audio channel in accordance with an embodiment of the present invention.

FIG. 22 is a graphical representation of the combined DTMF/wireless speaker audio signals in the time domain.

EXAMPLE 4

(FIGS. 23 to 26) Adult Toys

Adult Toy Setup

In this example the DTMF decoder 70 is connected to the isolated audio channel coming from the viewing platform so that the DTMF decoder only receives audio from one selected audio channel, in this example the left channel.

The speakers that are intended to produce the soundtrack/dialogue of an adult movie are both connected to the opposite audio channel to the DTMF decoder, in this example the right, so that the sound coming out of both speakers is split mono audio coming from the right channel.

An RF receiver is connected to a chosen adult toy 76. The adult toy contains motors. When receiving RF the RF receiver will activate chosen motors and functions of the adult toy, (different speeds, turning on/off different elements, etc)

This setup can also be wired the other way round and perform the same function depending on which channel the DTMF tones have been placed on the audio.

Media Setup

All audio intended to be physically heard, or to come from the viewing platform is placed in mono entirely on one selected audio channel. In this example the right channel.

A tone that has been allocated to activate an appropriate function of the adult toy (e.g. fast, slow, medium, stop) is chosen and placed on the opposing audio channel to the speakers (in this example the left channel) at specifically chosen points in the adult movie. This activates the toy in accordance with the film to simulate different sexual activities when the adult toy is being used and the movie is being watched.

Figure 24:
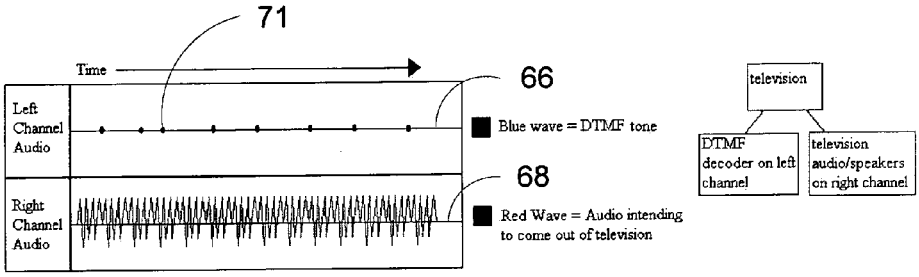
FIG. 24 shows a representation of the DTMF signals in the left audio channel and audio signals in the right audio channel in the arrangement of FIG. 23.
Figure 25:
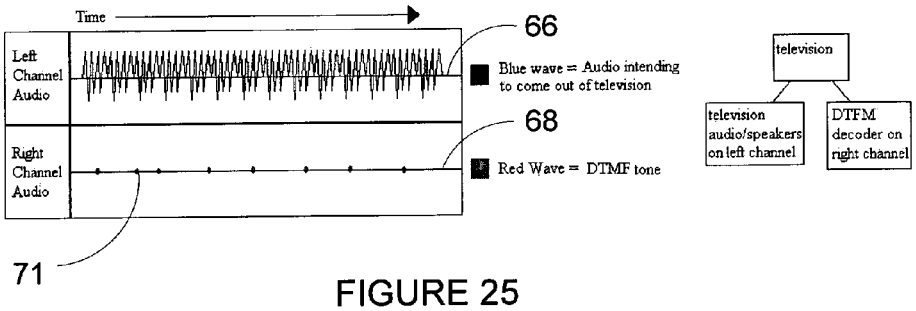
FIG. 25 shows a representation of the DTMF signals in the right audio channel and audio signals in the left audio channel in the arrangement of FIG. 23.
Figure 26:
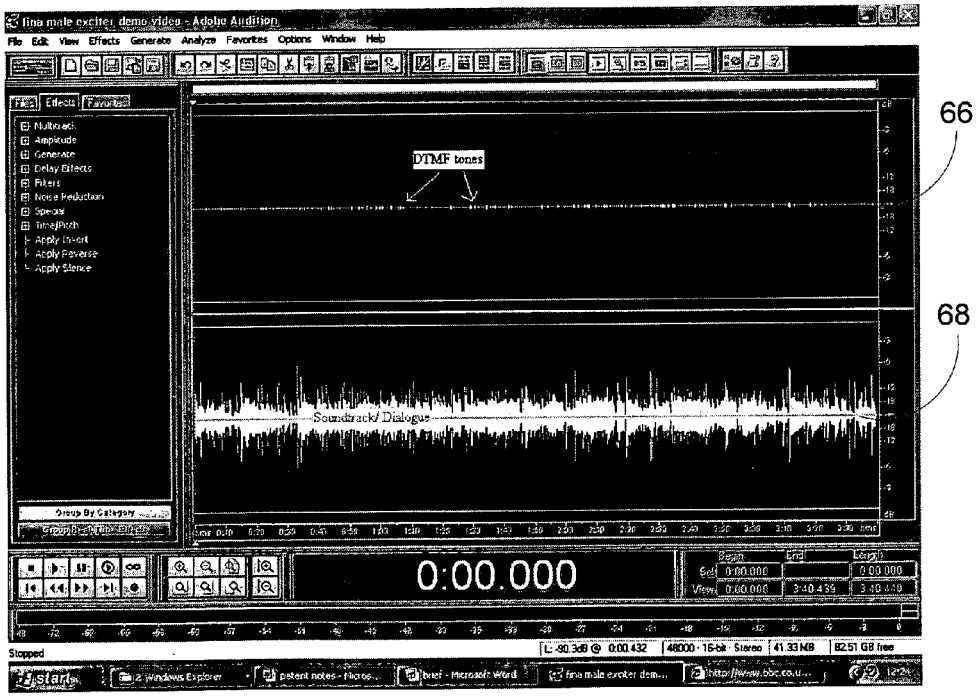
FIG. 26 shows a picture of the DTMF tones and audio signals for the arrangement shown in FIG. 23.

This aspect of the present invention is further illustrated in the drawings of FIGS. 24, 25 and 26 which show time domain audio signals with DTMF tones at various parts on one of the two audio channels.

EXAMPLE 5

Figure 27:
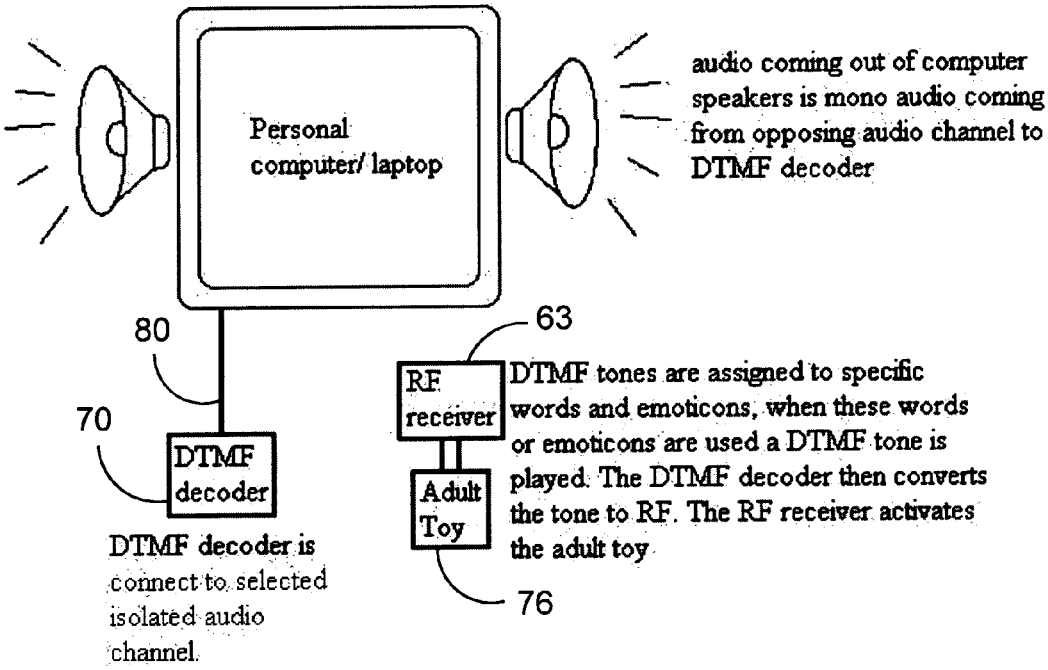
FIG. 27 shows an exemplary arrangement for on-line chat applications with an adult toy in accordance with an embodiment of the present invention.

(FIG. 27) Adult Toy on-Line Chat Applications

Setup

In this example DTMF decoder 70 is connected to the computer via a splitting phono cable 80, which isolates the selected audio channel.

The computers speakers are then connected to the other half of the splitting phono cable, which provides the speakers with mono audio coming from the opposite channel.

The RF receiver is programmed to activate certain speeds and functions of the adult toy when specific tones are played.

DTMF Tones can be assigned to chosen words or emoticons in chat, i.e. text applications, so that when people "chatting" on-line use certain 'tagged' words or emoticons, the computer emits a DTMF tone. The DTMF tone is then converted to RF by the DTMF decoder. The RF receiver then activates an adult toy worn by the user. Different tones that activate different functions of the adult toy can be assigned to different words and emoticons.

In another example toys/adult toys can also be activated using voice recognition from audio source input via selected viewing platform (i.e. DVD, CD player, personal entertainment devices)

Although the foregoing examples have been described with reference to DTMF tones SELCALL tones may be used instead. SELCALL is a system that uses a sequence of five audio tones that are sent as a short burst (squelch protocol) each tone can have ten different frequencies, this provides almost 100,000 different sequences. The receiver is programmed to respond only to a unique set of tones in a precise sequence. This can be used to prevent other sounds or tones from interfering with the RF receivers attached to the toys/adult toys.

Figure 28:
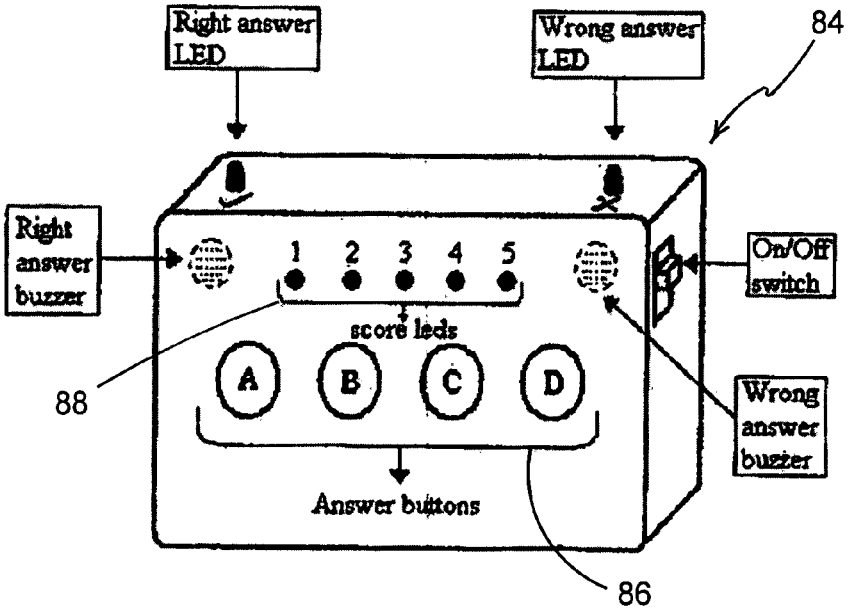
FIG. 28 shows a game controller/console receiving signals from a DTMF decoder over a selected audio channel by a wireless connection in accordance with an embodiment of the present invention.
Figure 29:
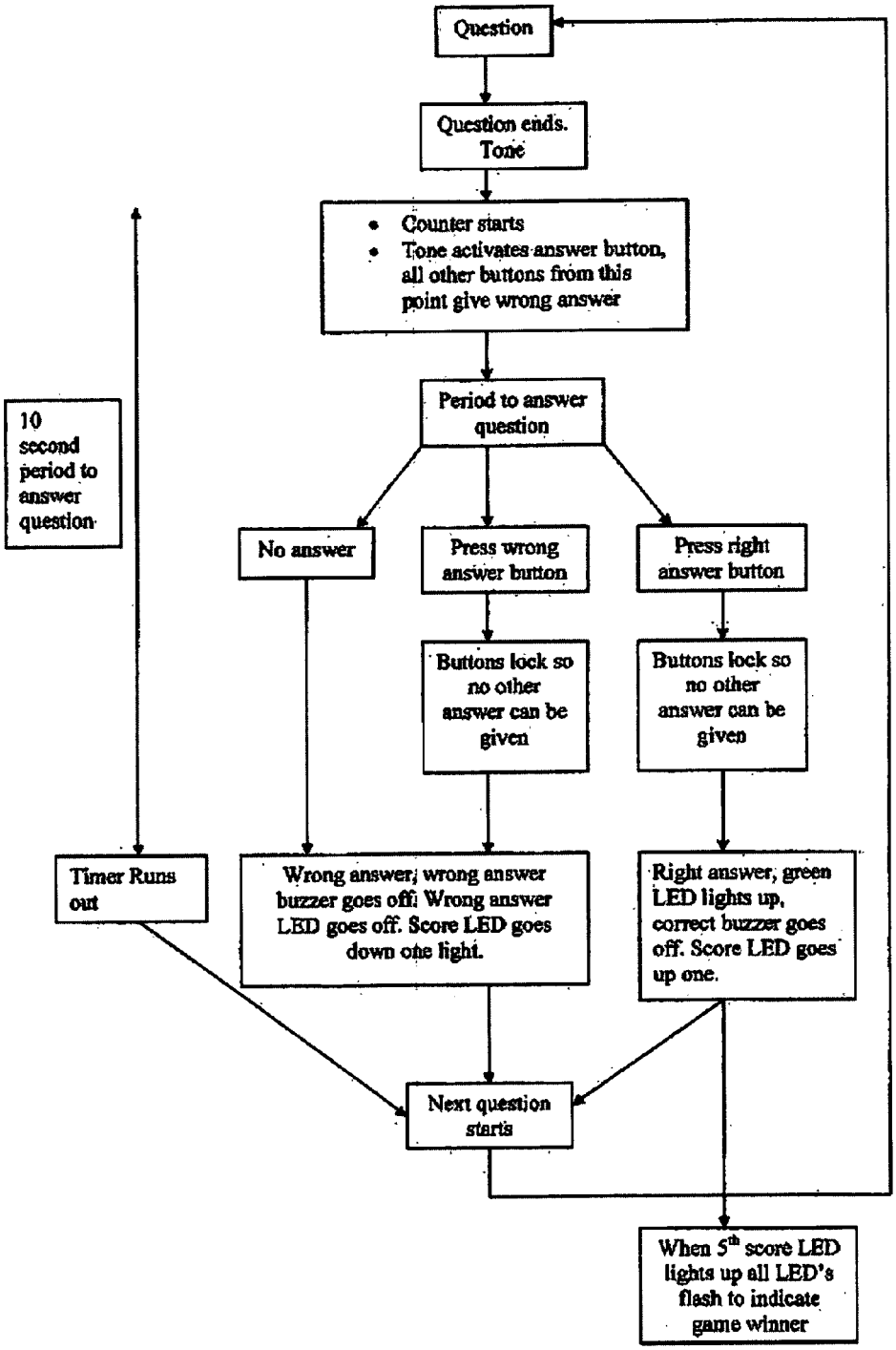
FIG. 29 is a flowchart of operations for the game controller/console of FIG. 28.
Figure 30:
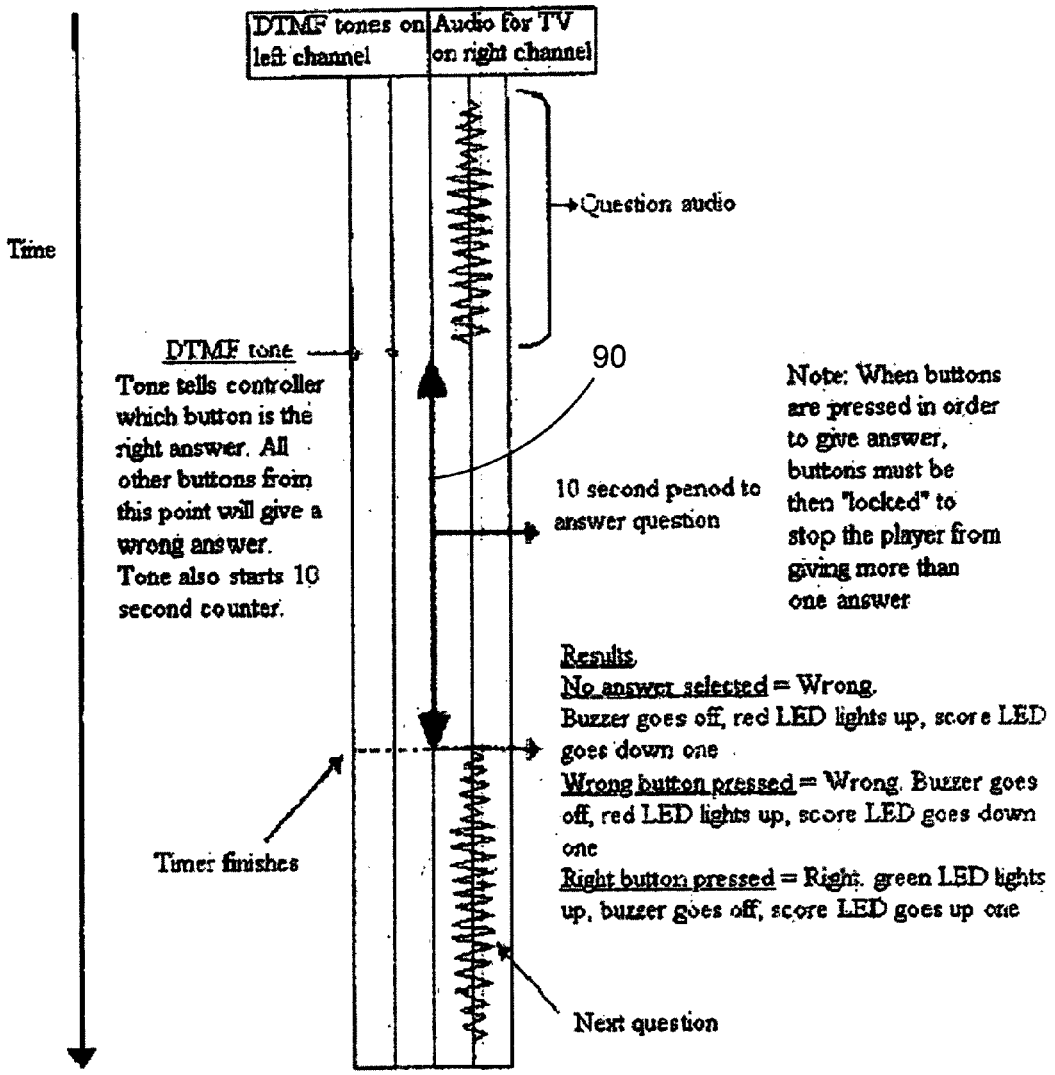
FIG. 30 shows the timing of operations for the game controller/console of FIG. 28.

Referring now to FIGS. 28, 29 and 30 which illustrate a further embodiment of the present invention. In this embodiment a games console 84 is provided for a multiple choice quiz game where questions are presented in audio and/or visual form on a listening and/or viewing platform. For example an audio signal on one of the two audio channels is fed to a television where the content of the audio signal is reproduced to ask a specific question. A DTMF tone on the other of the two audio channels is transmitted by a DTMF decoder. The games controller or console 84 is provided with four multiple choice buttons 86 and different DTMF tones are associated with each of these buttons so that the DTMF tone transmitted by the DTMF decoder after a particular question has been asked is the tone that is associated with the correct answer so that on receiving the DTMF signal each console 84 is provided with the correct answer for comparison with the answer indicated by the player. As shown in FIG. 30 the time period 90, in this example 10 seconds, is provided for each player to provide their answer and after this period the console 84 provides a visual and/or audible indication to the player whether the answer was correct or wrong. A counter is provided on the console as a series of LEDs 88 for keeping score. In the example illustrated in FIG. 30 if no answer is selected in the time period 90 a buzzer goes off on the console 84, a red LED lights up and the LED counter is reduced by one. The same process is followed if the wrong button is pressed by the player. If the correct button is pressed a green LED lights up, a buzzer goes off and the LED score counter 88 is incremented by one.

It is to be understood that the concept of controlling toys/products by using tones/wireless speaker transmitters etc, in the embodiments so far described can also be implemented with Bluetooth transmitters and receivers. Where the tones/audio intended to reach the product is placed entirely on one selected audio channel. Bluetooth transmits those audio signals wirelessly to the toy/product. The Bluetooth transmitter is connected/wired to one selected audio channel coming from the viewing/listening platforms audio source, e.g. DVD player, CD player, iPod, etc, via a channel separation adapter.

Embedding the Devices into Existing Technology that Uses Audio

The DTMF Decoder and the Wireless speaker transmitter, Bluetooth transmitter etc can be pre-installed into a DVD player, CD player, Television set, stereo, iPod, mobile phone, etc (any platform that uses stereo sound) during manufacture.

Musical Instruments—Learning Aid

DTMF tones can be used to wirelessly activate lights. These lights can be positioned or attached to keys on a keyboard, drums, etc.

Tones can then be placed and timed in accordance with a song, on one selected audio channel. The tones then activate the corresponding lights above the keys, in time with the notes being played, in order to teach the child/person how to play the instrument.

Light Box

DTMF tones can be used to wirelessly activate lights. Inserts can be placed over the lights depicting animals, shapes, numbers, letters etc.

Figure 31:
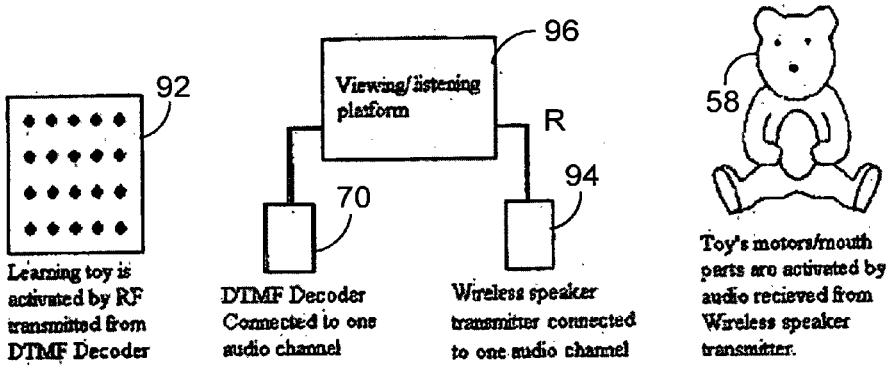
FIG. 31 shows an arrangement in which a light box is wirelessly connected to one audio channel carrying DTMF signals and a speaking children's toy is wirelessly connected to the second audio channel carrying audio signals, according to still another embodiment of the present invention.

Combining Wireless Speaking Toy and Tone Activated Toys (FIG. 31

A light box 92 activated by the DTMF Decoder 70 can be used in combination with the Wireless speaking toy 58. This can be done by connecting the Wireless speaker transmitter/Bluetooth 94 to one separated audio channel on the viewing/listening platform 96, then connecting the DTMF decoder to the subsequent separated audio channel.

The audio is separated using audio editing software. The audio intended to come out of the toy is placed entirely on one selected audio channel, in this example the right channel. The DTMF signals used to start the tone activated toys are placed on the other audio channel, in this example the left.

Figure 32:
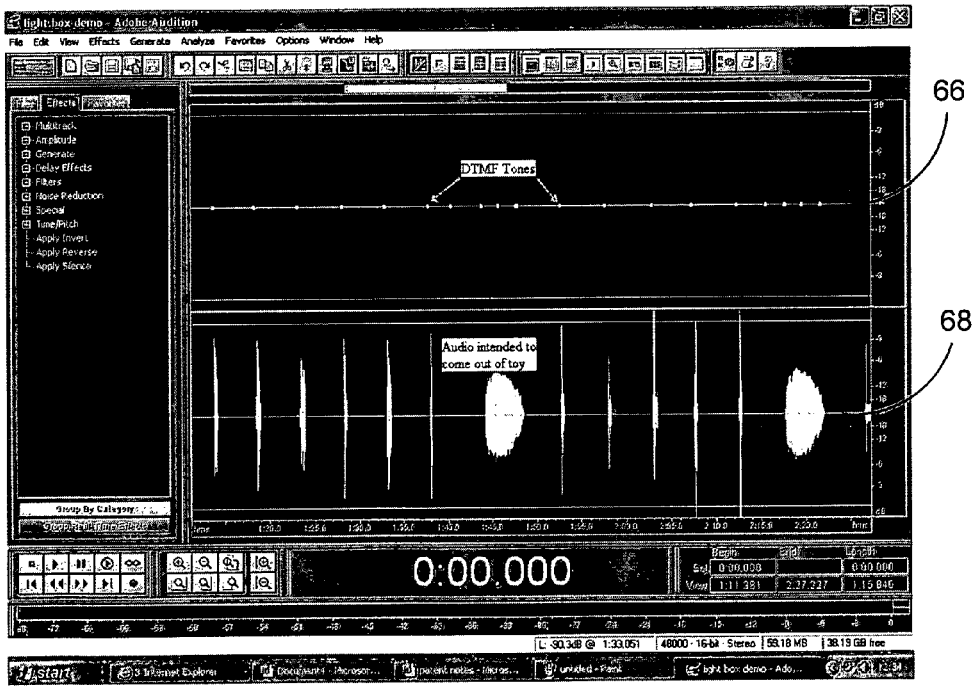
FIG. 32 shows a picture of exemplary DTMF and audio signals for the arrangement of FIG. 31.

An example of the DTMF/Wireless Speaker "stereo" audio signals is illustrated in FIG. 32.

In this embodiment the audio and tones are timed so that the Speaking Toy and the Tone activated toys correspond. For example the tone activated toy can light up numbers in time with the wireless speaking toy saying "One, Two, Three" etc.

Figure 33:
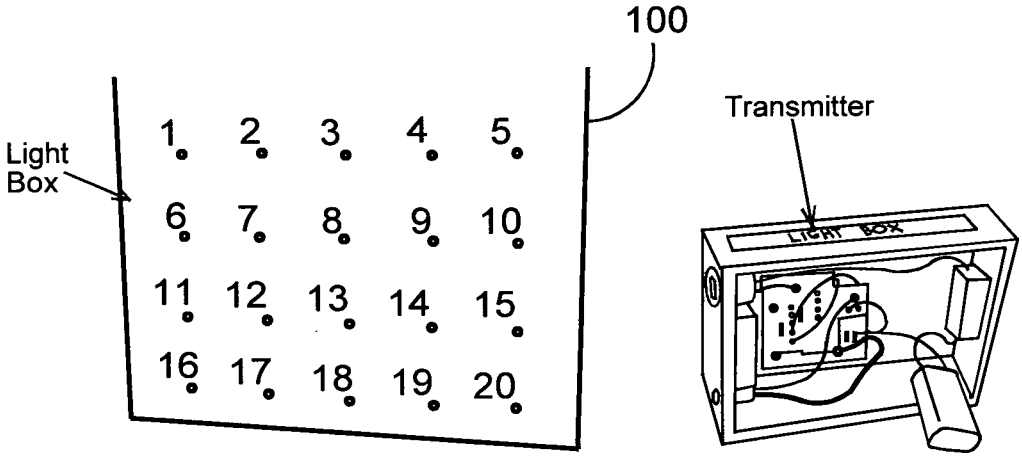
FIG. 33 shows an arrangement with a light box with lights activated by DTMF signals to operate as a teaching aid, according to another embodiment of the present invention.

Educational Teaching Aid (FIG. 33)

This embodiment concerns a system where DTMF tones are played causing LED's to light up on a light board 100. A single LED can be lit or any combination of two—twenty can be lit. This will work along side a media with questions or tasks and differing facures will be placed on the box according to the media being played. The board 100 has a receiver inside it, that picks up the tones broadcast from the transmitter from the media source.

i.e. A Numeric DVD game.

DVD—What is 2+2

Child—Will point/shout/touch indicated their answer

DVD—Its 4! Did you get that right?

Child—says YES/NO

Toy Train Set

This embodiment works on the same platform as previously described with activation by tones. An MP3 player is provided as an example of media source and when played causes, to a toy train to start moving around the track. This is done with a transmitter and a small receiver inside the train, so when a DTMF tone is played inside the normal audio from the media source the train will move. With a speaker added the train/engine could talk back to the media source, further adding to a child's learning experience.

The invention claimed is:

1. An audio switching device for an audio or audio/video entertainment system, the device comprising:

at least two audio inputs for receiving, in use, at least two respective input signals from a media source on respective input channels, and a switch selectively switching the audio switching device independently of an actuating signal embedded in the input signals, between:

i) a first mode of operation in which respective audio input signals are output for coupling to audio speakers of the entertainment system for stereo/multi-channel reproduction of the audio content of the audio input signals, and ii) a second mode of operation in which one of the audio input channels from the media source is isolated from the speakers of the entertainment system and switched to a transmitter audio output of the switch, and a wireless transmitter connected to the transmitter audio output of the switch, the wireless transmitter arranged to effect transmission of a combination of the media source's input channels with an overlaid control tone placed at one or more specific points in the isolated one input channel's time domain, the control tone controlling a particular movement/animation, whereby audio content of the isolated one of the media source's input channels can be output at a remote toy while movement/animation of the remote toy is synchronized to the remote audio output of the audio content by virtue of the control tone.

2. The audio switching device as in claim 1 wherein the switch is arranged to additionally connect, in the second mode, the audio input signal of another of the input channels from the media source to the respective audio speakers connected to the switched channel in the first mode.

3. The audio switching device as in claim 1 wherein the switch is selectively switched between the first and second modes when power to the audio switching device is switched between a first state and a second state.

4. The audio switching device as in claim 3 wherein the audio switching device operates in the first mode when it is switched off and in the second mode when the audio switching device is switched on.

5. The audio switching device as in claim 4 further comprising a physical switch for switching the audio switching device between the first and second modes.

6. The audio switching device as in claim 1 wherein the control tone is selected from the group consisting of:

a DTMF signal, a SELCALL signal, and sub-audio control signals.

7. The audio switching device as in claim 1 wherein the two audio inputs each respectively receiving one of two audio input channels from the media source are connected by the switch to first and second audio speakers of the entertainment system for stereo sound reproduction of the media source audio channels in the first mode, and wherein one of the audio input channels is connected by the switch to the wireless transmitter and the other audio input channel is connected by the switch to both first and second speakers for mono sound reproduction from both speakers in the second mode.

8. The audio switching device as in claim 1 wherein the control tone overlays the audio content of the isolated one of the input audio channels from the media source for the duration of the audio content.

9. An interactive audio or audio/video (AV) interactive entertainment system for processing multiple audio channels to provide, the system comprising:

an audio and/or video media source providing first and second audio channels;

an audio switching device including:

two audio inputs for receiving audio input signals in the first and second audio channels respectively, a switch selectively switching the audio switching device independently of an actuating signal embedded in the audio input signals, between:

i) a first mode of operation in which the audio channels are connected for stereo reproduction of the audio content of the audio input signals, and ii) a second mode in which one of the two audio channels from the media source is isolated and switched to a transmitter audio output of the switch, and a wireless transmitter connected to the transmitter audio output of the switch, the wireless transmitter arranged to effect transmission of a combination of the isolated one audio channel with an overlaid control tone placed at one or more specific points in the isolated one audio channel's time domain, the control tone controlling a particular movement/animation;

at least two speakers coupled to the audio switching device to selectively support both stereo audio output of the first and second audio channels and dual mono audio output of a selected one of said first and second audio channels; and a remote toy, operationally responsive to wireless transmissions from the audio switching device, the remote toy including:

a speaker for generating the audio content of the isolated one of the audio channels originating from the media source; and a motor for effecting movement of at least one part of the toy in time synchronization with the generated audio content;

wherein dual mono audio output is time synchronized with operation of the remote toy such that the first and second audio channels from the media source can be separately output from the remote toy and the two speakers.

10. The audio switching device as in claim 9 wherein the control tone overlays the audio content of the isolated one of the input audio channels from the media source for the duration of the audio content.

11. The system as in claim 10 wherein the control tone is selected from group consisting of:

a DTMF signal, a SELCALL signal, and sub-audio control signals.

12. The system as in claim 10 wherein the remote device comprises an educational toy.

13. The system as in claim 10 wherein the remote device comprises an interactive games console.

14. The system as in claim 10 wherein the audio switching device includes two stereo audio input channels for connection in the first mode to respective first and second speakers to provide stereo sound reproduction of the media source audio channels from the first and second speakers, and wherein audio switching device is arranged to switch one of the stereo audio input channels to the wireless transmitter in the second mode and connect the other stereo audio input channel to both first and second speakers to provide mono sound reproduction from both first and second speakers in the second mode.

15. A method of operating an audio switching device for an audio or audio/video entertainment system, comprising:

receiving, in use, at least two input signals from a media source on at least two respective audio input channels;

selectively switching the audio switching device independently of an actuating signal embedded in the input signals, between:

i) a first mode of operation in which respective audio input signals are output for coupling to audio speakers of the entertainment system for stereo/multi-channel reproduction of the audio content of the audio input signals, and ii) a second mode of operation in which one of the audio input channels from the media source is isolated from the speakers of the entertainment system and switched to a transmitter audio output of the switch, wirelessly transmitting a combination of the media source's input channels with an overlaid control tone placed at one or more specific points in the isolated one input channel's time domain, the control tone controlling a particular movement/animation, whereby audio content of the isolated one of the media source's input channels can be output at a remote toy while movement/animation of the remote toy is synchronized to the remote audio output of the audio content by virtue of the control tone.

16. The method as in claim 15 further comprising:

additionally connecting, in the second mode, the audio input signal of another of the input channels from the media source to the respective audio speakers connected to the switched channel in the first mode.

17. The method as in claim 15 wherein the selectively switching step switches between the first and second modes when power to the audio switching device is switched between a first state and a second state.

18. The method as in claim 17 wherein the audio switching device operates in the first mode when it is switched off and in the second mode when the audio switching device is switched on.

19. The method as in claim 15 further comprising selecting the control tone from the group consisting of:

a DTMF signal, a SELCALL signal, and sub-audio control signals.

* * * * *